US010219560B2

(12) United States Patent
Hewitt et al.

(10) Patent No.: US 10,219,560 B2
(45) **Date of Patent: *Mar. 5, 2019**

(54) GLOVE WITH HOOK-AND-LOOP FASTENER HAVING PLURAL HOOK AND/OR LOOP SECTIONS

(71) Applicant: NIKE, Inc., Beaverton, OR (US)

(72) Inventors: Jeremy J. Hewitt, Beaverton, OR (US); Matthew A. Rhoades, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 357 days.

This patent is subject to a terminal disclaimer.

(21) Appl. No.: 14/988,347

(22) Filed: Jan. 5, 2016

(65) Prior Publication Data

US 2016/0128402 A1 May 12, 2016

Related U.S. Application Data

(63) Continuation of application No. 13/460,328, filed on Apr. 30, 2012, now Pat. No. 9,265,293.

(51) Int. Cl.
*A41D 19/00* (2006.01)
*A63B 71/14* (2006.01)

(52) U.S. Cl.
CPC ..... *A41D 19/0048* (2013.01); *A63B 71/141* (2013.01)

(58) Field of Classification Search
CPC ..... A41D 19/0089; A41D 19/0048
USPC .... 2/16, 18–20, 160, 161.1, 161.6, 162, 170
See application file for complete search history.

(56) References Cited

U.S. PATENT DOCUMENTS

| | | | | |
|---|---|---|---|---|
| 3,348,238 | A | 10/1967 | Hydock | |
| 4,042,977 | A | 8/1977 | Antonious | |
| 4,071,913 | A | 2/1978 | Rector | |
| 4,400,831 | A | 8/1983 | Rietz | |
| 4,639,947 | A | 2/1987 | Lanscioni | |
| 4,649,574 | A | 3/1987 | Michels | |
| 4,881,275 | A | 11/1989 | Cazares et al. | |
| 4,991,234 | A | 2/1991 | Greenberg | |
| 5,023,952 | A | 6/1991 | Palmer | |
| 5,365,609 | A | 11/1994 | Herzog | |
| D356,203 | S | 3/1995 | Mitch | |
| 5,456,650 | A | 10/1995 | Williams, Jr. et al. | |
| 5,555,561 | A * | 9/1996 | Plachta | A41D 13/0005 2/270 |
| 5,682,611 | A | 11/1997 | Kline | |

(Continued)

*Primary Examiner* — Katherine Moran
(74) *Attorney, Agent, or Firm* — Honigman LLP; Matthew H. Szalach; Jonathan P. O'Brien

(57) ABSTRACT

A glove includes a main body that defines an interior space that is operable to receive at least a portion of the hand of the wearer. The main body includes an opening that divides the main body into a first portion and a second portion. The glove also includes a hook-and-loop fastener that includes a hook member and a loop member. The hook member and the loop member are operable to removably attach to each other. One of the hook member and the loop member is operably supported on the first portion of the main body, and the other of the hook member and the loop member is operably supported on the second portion of the main body. At least one of the hook member and the loop member is divided into a plurality of respective sections that are separated at a distance from each other.

20 Claims, 2 Drawing Sheets

(56) References Cited

U.S. PATENT DOCUMENTS

| | | | | |
|---|---|---|---|---|
| 5,742,941 | A | 4/1998 | Porter | |
| 6,223,354 | B1 | 5/2001 | Carothers | |
| 6,964,063 | B2 | 11/2005 | Bamber | |
| 7,051,377 | B1 | 5/2006 | Milner et al. | |
| 8,387,168 | B2 * | 3/2013 | Bautista | A63B 71/143 2/161.1 |
| 9,265,293 | B2 * | 2/2016 | Hewitt | A63B 71/141 |
| 2003/0051285 | A1 * | 3/2003 | Bower | A63B 71/141 2/16 |
| 2007/0234466 | A1 | 10/2007 | Stengel | |
| 2012/0030855 | A1 * | 2/2012 | Clark | A41D 19/0048 2/161.1 |

* cited by examiner

GLOVE WITH HOOK-AND-LOOP FASTENER HAVING PLURAL HOOK AND/OR LOOP SECTIONS

CROSS REFERENCE TO RELATED APPLICATIONS

This application is a continuation of U.S. patent application Ser. No. 13/460,328 filed Apr. 30, 2012, now U.S. Pat. No. 9,265,293, the disclosure of which is incorporated by reference in its entirety.

FIELD

The present disclosure relates to a glove and, more particularly, to a glove with a hook-and-loop fastener having plural hook and/or loop sections.

BACKGROUND

This section provides background information related to the present disclosure which is not necessarily prior art.

There are several types of gloves for a wide variety of uses. For instance, many athletes wear gloves when participating in particular sports activities. Baseball players, for example, wear batting gloves when at-bat to improve the grip on the bat and to thereby improve batting performance. Golfers wear similar gloves to improve the grip on the golf club. Other athletes involved in other sports wear gloves for other reasons as well (e.g., to maintain warm hands, etc.).

Many gloves can include a closure or fastener used to selectively tighten and secure the glove to the hand. The fastener can include buttons, snaps, buckles, or other types. In some cases, the fastener can be a hook-and-loop fastener (i.e., pile tape), such as VELCRO™. The hook member of the fastener can removably attach to the loop member by layering the portions over each other and pressing the portions together. The portions can be pulled and peeled apart to detach the hook and loop members. The portions can be quickly and repeatedly attached and detached without significantly compromising the closure. As such, the closure can be a convenient and effective means for securing the glove to the wearer's hand.

The fastener typically includes a single, elongate, continuous strip of the hook member and a corresponding single, elongate, continuous strip of the loop member. The hook and loop members often have the same length and width.

The fastener can have a degree of rigidity such that the fastener resists bending about the wearer's hand. As such, the hook and loop fastener can detrimentally affect the fit of the glove to the wearer's hand. Furthermore, the fastener can be bulky, can significantly increase the weight of the glove, and/or can negatively affect the aesthetics of the glove.

SUMMARY

This section provides a general summary of the disclosure, and is not a comprehensive disclosure of its full scope or all of its features.

A glove is disclosed that is operable to be worn on a hand of a wearer. The glove includes a main body that defines an interior space that is operable to receive at least a portion of the hand of the wearer. The main body includes an opening that divides the main body into a first portion and a second portion. The glove also includes a hook-and-loop fastener that includes a hook member and a loop member. The hook member and the loop member are operable to removably attach to each other. One of the hook member and the loop member is operably supported on the first portion of the main body, and the other of the hook member and the loop member is operably supported on the second portion of the main body. At least one of the hook member and the loop member is divided into a plurality of respective sections that are separated at a distance from each other.

Additionally, a glove that is operable to be worn on a hand of a wearer is disclosed. The glove includes a main body that defines an interior space that is operable to receive at least a portion of the hand of the wearer. The main body includes a first portion and a second portion. The glove further includes a hook-and-loop fastener that includes a hook member and a loop member. The hook member and the loop member are operable to removably attach to each other. One of the hook member and loop member is operably supported on the first portion of the main body, and the other of the hook member and the loop member is operably supported on the second portion of the main body. At least one of the hook member and the loop member is divided into a plurality of sections that are separated at a distance from each other. The plurality of sections are aligned in a row, and each of the plurality of sections has a width. The widths are progressively smaller along the row.

Still further, a baseball batter's glove that is operable to be worn on a hand of a wearer is disclosed. The baseball batter's glove includes a main body that includes a wrist region operable to receive a wrist of the wearer, a metacarpal region operable to cover at least a portion of a metacarpal area of the wearer, and a finger region operable to receive at least a portion of a finger of the wearer. The main body defines an interior space that is operable to receive the wrist, metacarpal, and finger of the wearer. The main body also includes an elastic band and an elongate strap that define the wrist region. The elastic band includes an edge, and the main body includes a slit that extends from the edge, across the wrist region, and into the metacarpal region where the slit terminates. The slit defines a space between the resiliently elastic band and the elongate strap. Additionally, the glove includes a hook-and loop fastener that includes a hook member and a loop member. The hook member and the loop member are operable to removably attach to each other. One of the hook member and the loop member is a continuous strip that is fixed to the elongate strap, and the other of the hook member and the loop member is divided into a plurality of sections that are separated at a distance from each other on the resiliently elastic band. The plurality of sections are aligned in a row, and the row defines a direction that points away from the slit. Each of the plurality of sections have a width, and the widths are progressively smaller along the row in the direction pointing away from the slit. The elongate strap is operable to selectively extend across the slit to removably attach the hook member and the loop member together.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
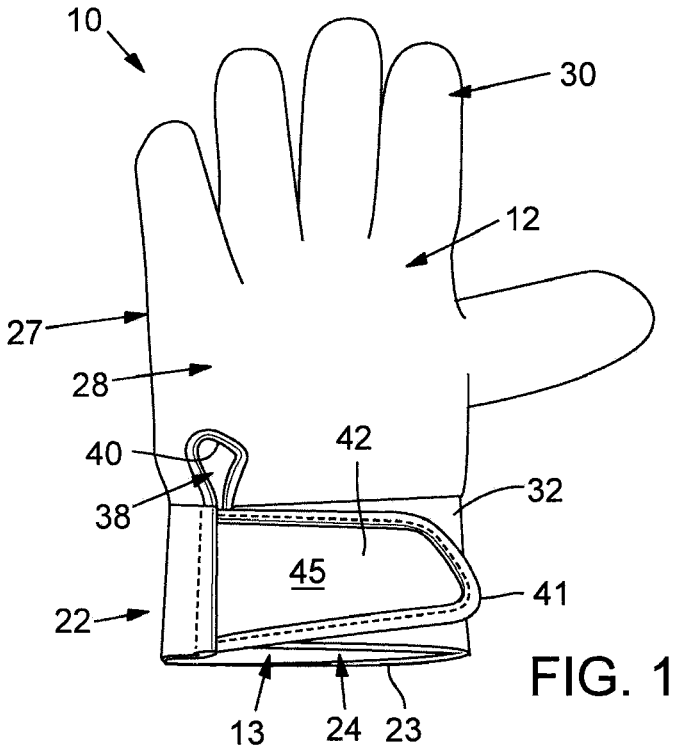
FIG. 1 is a back view of a glove according to exemplary embodiments of the present disclosure, wherein the glove includes a hook-and-loop fastener that is shown in a secured position.
Figure 2:
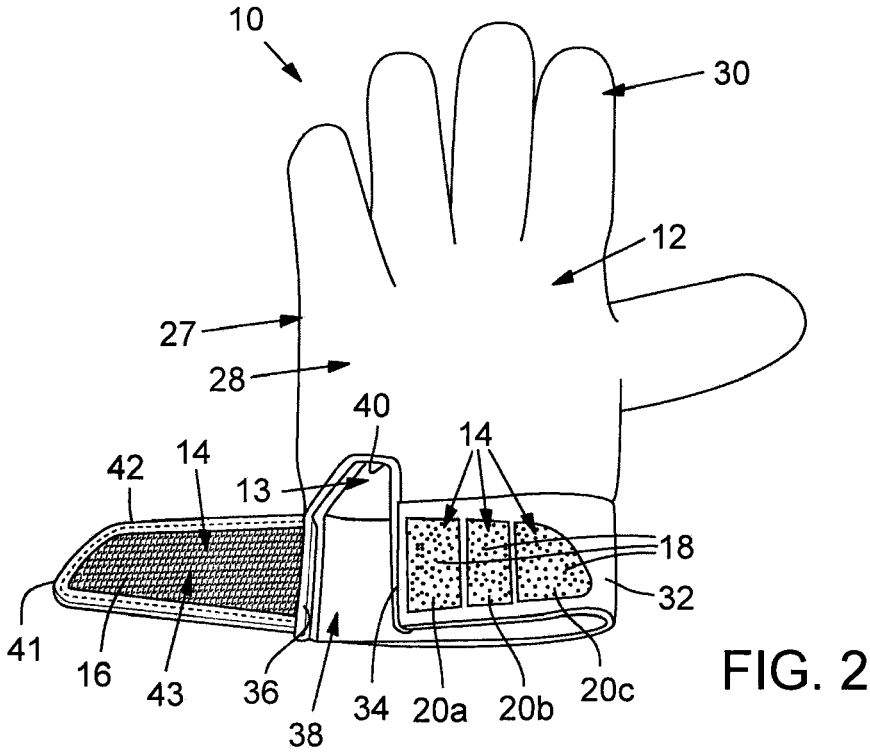
FIG. 2 is a back view of the glove of FIG. 1, wherein the hook-and-loop fastener is shown in an unsecured position.
Figure 3:
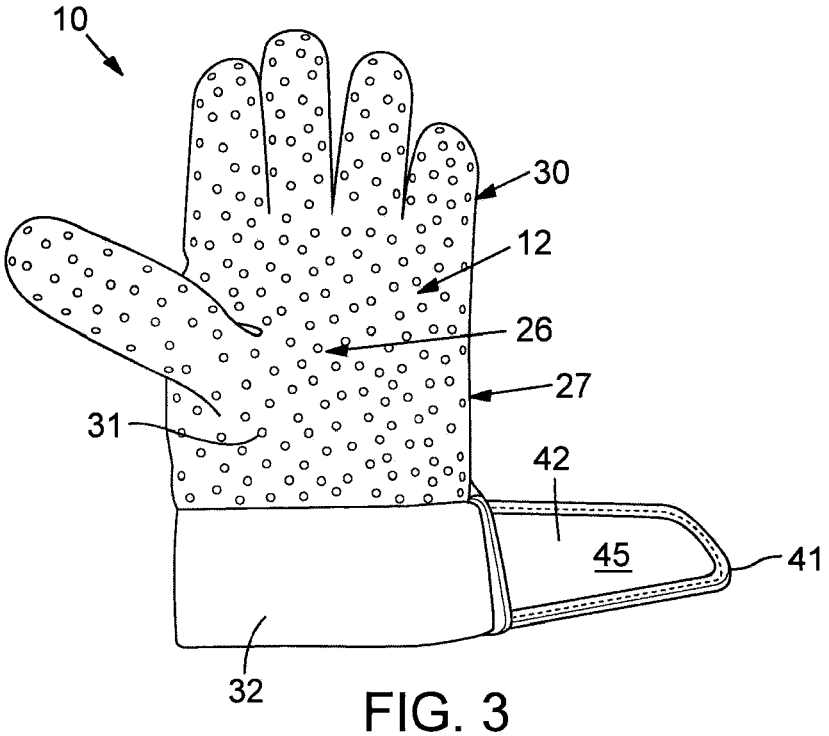
FIG. 3 is a front view of the glove of FIG. 1.

Referring initially to FIGS. 1-3, a glove 10 is illustrated according to various exemplary embodiments of the present disclosure. The glove 10 can generally include a main body 12 that defines an interior space 13 that is operable to receive at least a portion of a hand of a wearer (not shown). The glove 10 can also include a hook-and-loop fastener 14 having a hook member 16 and a loop member 18 (see FIG. 2). The hook member 16 can removably and selectively attach to the loop member 18 to secure the glove 10 to the wearer's hand. In some embodiments, the hook-and-loop fastener 14 (i.e., pile tape, hook tape, loop tape, etc.) can be VELCRO™, which is commercially available from Velcro USA, Inc.

As will be discussed in detail below, at least one of the hook member 16 and loop member 18 can be divided into a plurality of respective sections 20*a*, 20*b*, 20*c* that are separated at a distance from each other. For instance, in the embodiments shown in FIGS. 2 and 4, the loop member 18 can be divided into a plurality (e.g., three) sections 20*a*, 20*b*, 20*c*. It will be appreciated that there can be any number of sections 20*a*, 20*b*, 20*c*. It will also be appreciated that the hook member 16 could be divided into sections 20*a*, 20*b*, 20*c* instead of, or in addition to, the loop member 18.

Also, by including a plurality of separate sections 20*a*, 20*b*, 20*c*, the hook-and-loop fastener 14 can make the glove 10 more comfortable to wear. This is because the sections 20*a*, 20*b*, 20*c* can allow the glove 10 to more closely conform to and wrap about the wearer's body. Also, the glove 10 can more securely fit to the wearer's hand such that the glove 10 can be used more effectively (e.g., by providing better gripping capabilities, etc.).

It will be appreciated that the glove 10 can be of any suitable type. For instance, the glove 10 can be a baseball batter's glove, which enhances the wearer's ability to grip a baseball bat. However, the glove 10 can be a golfing glove for enhancing a grip on a golf club, a soccer goalie's glove, or another type of glove 10 for another type of sports-related activity. The glove 10 can also be unrelated to sports and can be worn for keeping the wearer's hands warm, for keeping the wearer's hands clean, or for any other suitable activity.

Furthermore, FIGS. 1-4 illustrate the glove 10 as being wearable on a left hand. However, the glove 10 can be modified to be wearable on the right hand without departing from the scope of the present disclosure.

Referring now to FIGS. 1-4, embodiments of the glove 10 will be discussed in greater detail. In the embodiments illustrated, the glove 10 is intended to be worn over substantially an entirety of the wearer's hand, including the wrist. As such, the main body 12 of the glove 10 can include a wrist region 22 operable to receive and to at least partially cover a wrist or carpal bones (not shown) of the wearer's hand. The main body 12 can also include a metacarpal region 27 operable to receive and at least partially cover the metacarpal area (i.e., palm and back of the hand) of the wearer. Furthermore, the main body 12 can include a finger region 30 operable to receive and at least partially cover at least one of the wearer's fingers.

Figure 4:
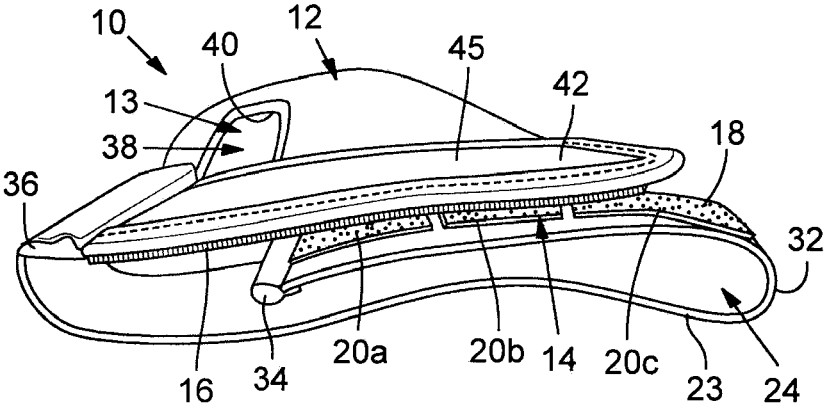
FIG. 4 is an end view of the glove of FIG. 1, wherein the fastener is shown in a secured position.

The wrist region 22 can include an edge 23 (i.e., terminal edge) that defines a passage 24 (see FIG. 4). The passage 24 can allow movement of the wearer's hand into and out of the interior space 13 of the glove 10. The wrist region 22 can be elongate so as to wrap around both the front and back of the wearer's wrist.

The metacarpal region 27 can include a palm region 26 (FIG. 3) for covering the palm (i.e., front) of the wearer's hand. The metacarpal region 27 can also include a back region 28 for covering the back of the wearer's hand.

The finger region 30 can include a plurality of tubes (e.g., five tubes) that extend from the metacarpal region 27 and that are closed at one end. Accordingly, the finger region 30 can receive one or more of the wearer's fingers, including the thumb. It will be appreciated that the finger region 30 can be configured to receive less than all of the fingers of the wearer's hand, and the metacarpal region 27 can include one or more corresponding holes (not shown) through which uncovered fingers can extend out.

In some embodiments, the main body 12 can be made out of one or more sheets of leather, faux-leather, polyester, mesh material, tacky or otherwise high-friction material, or any other suitable material. The material can be flexible to bend, fold, and bunch for fitting about the wearer's hand and to allow natural movement of the wearer's fingers, metacarpals, and wrist. The main body 12 can also include stitching, adhesives, or other means of interconnection of the different portions of the main body 12. The material of the main body 12 can be ventilated or can be otherwise "breathable" to allow the wearer's perspiration to evaporate away from the hand. Also, the main body 12 can be insulated for keeping the wearer's hand warm. In some embodiments, one or more portions the material of the main body 12 can be resiliently elastic to stretch about the wearer's hand, or the material can be non-elastic in some embodiments as well. Furthermore, the palm region 26 and/or other portions of the main body 12 can include bumps 31 (FIG. 3), surface roughness, high-friction material, or other similar features for increasing friction thereon. Accordingly, the glove 10 can improve the wearer's gripping capabilities.

The main body 12 can additionally include a resiliently elastic band 32. The elastic band 32 can be made from a woven elastic material. The elastic band 32 can be elongate and can include a first end 34 and a second end 36. The elastic band 32 can define a majority of the wrist region 22 of the glove 10 and can be fixed to the metacarpal region 27 via stitching, adhesives, or other means. The elastic band 32 can also define the edge 23 of the glove 10 described above. Thus, the elastic band 32 can define the passage 24 into and out of the glove 10. Accordingly, the resiliency and elasticity of the band 32 can allow the size of the passage 24 to be varied. For instance, FIGS. 1-4 can illustrate a "neutral position" of the band 32, and when a hand is inserted through the passage 24, the band 32 can resiliently extend and stretch over the hand to allow passage. Once the hand has moved fully into the interior space 13, the band 32 can recover resiliently toward its "neutral position" to fit snugly about the wearer's wrist. The band 32 can similarly resiliently stretch when the hand is removed from the interior space 13.

Furthermore, the main body 12 of the glove 10 can include a strap 42. The strap 42 can be flat and elongate and can include an inner side 43 and a back side 45. In some embodiments, the strap 42 can be flexible but non-elastic such that the strap 42 has a substantially fixed length. The strap 42 can be fixed to the second end 36 of the elastic band 32 and can extend freely therefrom. In some embodiments, the strap 42 can include a free end 41 that tapers substantially to a point. The pointed free end 41 can be disposed adjacent the edge 23 of the wrist region 22.

Additionally, the glove 10 can include an opening 38 (FIGS. 1, 2, and 4) that divides the main body 12 into first and second portions. As shown in FIG. 2, the opening 38 can be a slit 40 that divides the first end 34 of the elastic band 32 ("first portion" of the main body 12) from the second end 36 of the band 32 and the strap 42 ("second portion" of the main body 12). The slit 40 can extend from the edge 23 and across the wrist region 22, and the slit 40 can terminate in the back region 28 of the metacarpal region 27. However, it will be appreciated that the opening 38 can be a through-hole or another type, and the opening 38 can be included anywhere on the glove 10 without departing from the scope of the present disclosure. Furthermore, as will be discussed, the strap 42 can extend across the slit 40 for securing the glove 10 to the hand.

In the embodiments illustrated, the loop member 18 of the hook-and-loop fastener 14 is fixed on the first end 34 of the elastic band 32 via stitching, adhesives, etc. Also, in the embodiments illustrated, the hook member 16 of the fastener 14 is fixed on the inner side 43 of the strap 42 via stitching, adhesives, etc. It will be appreciated, however, that the loop member 18 could be attached to the strap 42 while the hook member 16 could be attached to the elastic band 32.

As shown in FIG. 2, the hook member 16 can be a continuous, elongate strip of hook material that substantially covers an entirety of the inner side 43 of the strap 42. Thus, the hook member 16 can taper down substantially to a point along its length.

Moreover, as mentioned above, the loop member 18 can be divided into a plurality of sections 20*a*, 20*b*, 20*c* that are separated at a distance from each other. The sections 20*a*, 20*b*, 20*c* can be aligned in a row along the wrist region 22. Also, as shown in FIG. 2, the widths of the sections 20*a*, 20*b*, 20*c* can get progressively smaller along the row in a direction moving away from the slit 40. In some embodiments, the tapering width of the sections 20*a*, 20*b*, 20*c* can substantially match the tapering width of the strap 42 and the tapering width of the hook member 16.

Use of the glove 10 will now be discussed. Assuming that the glove 10 is in the unsecured position shown in FIG. 2 and the user wishes to put on the glove 10, the user can move a hand through the passage 24 until the wrist, metacarpal, and finger region 22, 27, 30 cover the respective areas of the hand. Then, the user can bend and pull the strap 42 toward the loop member 18 to extend the strap 42 across the slit 40 and to removably attach the hook and loop members 16, 18 together. In so doing, the user can draw the slit 40 at least partially closed to thereby tighten the glove 10 to the hand. Once the hook and loop members 16, 18 are removably attached, the glove 10 can fit snugly and securely on the wearer's hand.

To remove the glove 10, the wearer can peel the hook and loop members 16, 18 away from each other by grasping the strap 42 and moving the strap 42 away from the first end 34 of the elastic band 32. This can result in widening the slit 40, and can allow the wearer to pull the glove 10 from the hand.

Accordingly, the glove 10 can be quickly and conveniently secured to and unsecured from the wearer's hand. Also, the glove 10 can fit more securely and more comfortably on the wearer's hand. More specifically, by dividing the loop member 18 into sections 20*a*, 20*b*, 20*c*, the loop member 18 is less likely to resist bending about the wearer's wrist. As such, the elastic band 32 can better conform and more comfortably fit about the wearer's wrist. Furthermore, the glove 10 can more securely fit to the hand and is more likely to remain in an intended position on the hand.

Additionally, the sections 20*a*, 20*b*, 20*c* can allow the elastic band 32 to stretch further in the longitudinal direction as compared to a single continuous strip. This is because portions of the band 32 between the sections 20*a*, 20*b*, 20*c* can resiliently stretch. Accordingly, the band 32 can stretch further to accommodate a larger variety of hands.

Still further, because the hook-and-loop fastener 14 is split partially into the sections 20*a*, 20*b*, 20*c*, the hook-and-loop fastener 14 can have a lower weight and can be less bulky than those of the prior art. Accordingly, the glove 10 can allow the wearer to move the hand more quickly or otherwise improve performance.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A glove comprising:

a main body including an opening operable to receive a body part of a wearer and an interior space in communication with the opening, the main body including a continuous region disposed proximate to the opening, extending continuously between a first end and a second end, and being elastic and extendable;

a slit formed into the main body and extending away from the opening, the first end and the second end of the continuous region terminating at opposite sides of the slit;

a strap having an attached end that is attached to the second end of the continuous region and a free end that is spaced apart from the second end of the continuous region; and a hook-and-loop fastener including a first member being one of a hook member and a loop member and a second member being the other of the hook member and the loop member, the first member including a plurality of discrete segments that (i) are spaced apart from one another, (ii) are attached to the continuous region proximate to the first end, and (iii) decrease in size in a direction extending along the continuous region and away from the first end, the second member being attached to the strap, the second member being attached to the first member in an attached state to decrease an effective size of the opening and being separated from the first member in a detached state to increase an effective size of the opening.

2. The glove of claim 1, wherein the continuous region is exposed between the plurality of discrete segments of the first member.

3. The glove of claim 1, wherein the continuous region is formed from a woven elastic material, the woven elastic material being exposed in regions between the plurality of discrete segments of the first member.

4. The glove of claim 1, wherein the plurality of discrete segments are separated at a distance from one another along the continuous region.

5. The glove of claim 1, wherein portions of the continuous region between adjacent ones of the plurality of discrete segments are configured to stretch.

6. The glove of claim 1, wherein the free end of the strap includes a taper.

7. A glove comprising:

a main body including an opening operable to receive a body part of a wearer and an interior space in communication with the opening, the main body including a continuous region disposed proximate to the opening, extending continuously between a first end and a second end, and being elastic and extendable;

a slit formed into the main body and extending away from the opening, the first end and the second end of the continuous region terminating at opposite sides of the slit;

a strap having an attached end that is attached to the second end of the continuous region and a free end that is spaced apart from the second end of the continuous region; and a hook-and-loop fastener including a first member being one of a hook member and a loop member and a second member being the other of the hook member and the loop member, the first member including a plurality of discrete segments that are attached to the continuous region and decrease in size in a direction extending along the continuous region and away from the first end, and the second member being attached to the strap, the second member being attached to the first member in an attached state to decrease an effective size of the opening and being separated from the first member in a detached state to increase an effective size of the opening.

8. The glove of claim 7, wherein the continuous region is exposed between the plurality of discrete segments of the first member.

9. The glove of claim 7, wherein the continuous region is formed from a woven elastic material, the woven elastic material being exposed in regions between the plurality of discrete segments of the first member.

10. The glove of claim 7, wherein the plurality of discrete segments are separated at a distance from one another along the continuous region.

11. The glove of claim 7, wherein portions of the continuous region between adjacent ones of the plurality of discrete segments are configured to stretch.

12. The glove of claim 7, wherein the second member includes a taper.

13. A glove comprising:

a main body including an opening operable to receive a body part of a wearer and an interior space in communication with the opening, the main body including a continuous region disposed proximate to the opening, extending continuously between a first end and a second end, and being elastic and extendable;

a slit formed into the main body and extending away from the opening, the first end and the second end of the continuous region terminating at opposite sides of the slit;

a strap having an attached end that is attached to the second end of the continuous region and a free end that is spaced apart from the second end of the continuous region; and a hook-and-loop fastener including a first member being one of a hook member and a loop member and a second member being the other of the hook member and the loop member, the first member including a plurality of discrete segments that (i) are spaced apart from one another, (ii) are attached to the continuous region proximate to the first end, (iii) are aligned in a row along the continuous region, and (iv) include widths that get progressively smaller along the row in a direction moving away from the slit, the second member being attached to the strap, and the second member being attached to the first member in an attached state to decrease an effective size of the opening and being separated from the first member in a detached state to increase an effective size of the opening.

14. The glove of claim 13, wherein the continuous region is exposed between the plurality of discrete segments of the first member.

15. The glove of claim 13, wherein the continuous region is formed from a woven elastic material, the woven elastic material being exposed in regions between the plurality of discrete segments of the first member.

16. The glove of claim 13, wherein portions of the continuous region between adjacent ones of the plurality of discrete segments are configured to stretch.

17. A glove comprising:

a main body including an opening operable to receive a body part of a wearer and an interior space in communication with the opening, the main body including a continuous region disposed proximate to the opening, extending continuously between a first end and a second end, and being elastic and extendable;

a slit formed into the main body and extending away from the opening, the first end and the second end of the continuous region terminating at opposite sides of the slit;

a strap having an attached end that is attached to the second end of the continuous region and a free end that is spaced apart from the second end of the continuous region; and a hook-and-loop fastener including a first member being one of a hook member and a loop member and a second member being the other of the hook member and the loop member, the first member including a plurality of discrete segments that (i) are attached to the continuous region, (ii) are aligned in a row along the continuous region, and (iii) include widths that get progressively smaller along the row in a direction moving away from the slit, the second member being attached to the strap, and the second member being attached to the first member in an attached state to decrease an effective size of the opening and being separated from the first member in a detached state to increase an effective size of the opening.

18. The glove of claim 17, wherein the continuous region is exposed between the plurality of discrete segments of the first member.

19. The glove of claim 17, wherein the continuous region is formed from a woven elastic material, the woven elastic material being exposed in regions between the plurality of discrete segments of the first member.

20. The glove of claim 17, wherein portions of the continuous region between adjacent ones of the plurality of discrete segments are configured to stretch.

* * * * *